US012691352B1

(12) United States Patent
Alfred

(10) Patent No.: US 12,691,352 B1
(45) Date of Patent: Jul. 28, 2026

(54) RACQUET SWING TRAINING SYSTEM AND METHOD OF SWING TRAINING

(71) Applicant: Jeff R. Alfred, Flagstaff, AZ (US)

(72) Inventor: Jeff R. Alfred, Flagstaff, AZ (US)

(73) Assignee: PADDLE PAL TRAINER LLC, Flagstaff, AZ (US)

( * ) Notice: Subject to any disclaimer, the term of this patent is extended or adjusted under 35 U.S.C. 154(b) by 890 days.

(21) Appl. No.: 18/085,213

(22) Filed: Dec. 20, 2022

Related U.S. Application Data

(60) Provisional application No. 63/291,850, filed on Dec. 20, 2021.

(51) Int. Cl.

| | |
|---|---|
| ***A63B 69/38*** | (2006.01) |
| ***A63B 21/04*** | (2006.01) |
| ***A63B 21/055*** | (2006.01) |
| *A63B 69/00* | (2006.01) |
| *A63B 102/06* | (2015.01) |
| *A63B 102/16* | (2015.01) |

(52) U.S. Cl.
CPC ..... *A63B 69/38* (2013.01); *A63B 21/0442* (2013.01); *A63B 21/0557* (2013.01); *A63B 69/0017* (2013.01); *A63B 2102/06* (2015.10); *A63B 2102/065* (2015.10); *A63B 2102/16* (2015.10); *A63B 2214/00* (2020.08)

(58) Field of Classification Search
CPC . A63B 69/38; A63B 21/0442; A63B 21/0052; A63B 21/0555; A63B 21/0057; A63B 69/0017; A63B 2102/06; A63B 2102/065; A63B 2102/16; A63B 2102/02; A63B 2102/08; A63B 2214/00
See application file for complete search history.

(56) References Cited

U.S. PATENT DOCUMENTS

| | | | | |
|---|---|---|---|---|
| 2,134,451 | A | 10/1938 | Norman | |
| 3,709,490 | A | 1/1973 | Pruss | |
| 3,858,881 | A | 1/1975 | Hurwitz | |
| 3,937,465 | A | 2/1976 | Rolson | |
| 4,150,821 | A | 4/1979 | Racz | |
| 4,209,169 | A | 6/1980 | Roberts | |
| 4,251,071 | A | 2/1981 | Norton | |
| 4,328,964 | A * | 5/1982 | Walls | A63B 21/0552 482/129 |
| 4,445,686 | A | 5/1984 | Daugherty | |
| 5,005,833 | A | 4/1991 | Groveman et al. | |
| 5,158,299 | A | 10/1992 | Otter | |
| 5,286,021 | A * | 2/1994 | Shaw | A63B 15/00 473/437 |
| 5,476,257 | A | 12/1995 | Bobby | |
| 5,618,040 | A | 4/1997 | Parten | |
| 5,649,699 | A | 7/1997 | Todoroff | |

(Continued)

*Primary Examiner* — Raleigh W Chiu
(74) *Attorney, Agent, or Firm* — Invention To Patent Services; Alex Hobson

(57) ABSTRACT

A racquet swing training system utilizes a cover having hooks coupled thereto that are configured to couple with elastic bands to provide resistance during a swing motion. The hook on the cover is effectively retained and secured by a stiffener plate. In addition, the hooks may be coupled with a pivot to enable the hooks to rotate down parallel with the cover for compact storage. A plurality of hooks may be configured on the cover to provide different training options. A plurality of elastic bands may be provided and some may provide higher resistance than others.

18 Claims, 6 Drawing Sheets

(56) References Cited

U.S. PATENT DOCUMENTS 6,048,281 A * 4/2000 Place ..... A63B 21/0552 482/121
6,592,474 B1 * 7/2003 Halsworth ..... A63B 21/154 482/121
7,322,894 B2 1/2008 Cohen et al.
7,677,992 B2 3/2010 Moos
7,749,110 B2 7/2010 Bozor
7,998,036 B2 8/2011 Rasmussen et al.
8,556,755 B1 * 10/2013 Zackery ..... A63B 21/4009 473/424
8,777,783 B1 7/2014 Bilsey et al.
9,370,702 B1 6/2016 Reilly
9,610,487 B2 4/2017 Ahn
10,086,250 B2 10/2018 Wright
10,709,952 B2 7/2020 Shwartzman
2004/0229736 A1 11/2004 Dise et al.
2007/0123372 A1 * 5/2007 Bilsey ..... A63B 69/38 473/464
2007/0275796 A1 * 11/2007 Carter ..... A63B 69/38 473/553
2010/0035706 A1 2/2010 Sanchez
2010/0331125 A1 * 12/2010 Enday ..... A63B 69/38 473/463
2011/0130255 A1 6/2011 Charlton
2011/0237359 A1 9/2011 Purl
2013/0085021 A1 * 4/2013 Schoenwetter ..... A63B 21/075 473/437
2016/0045801 A1 2/2016 Malkin
2018/0169494 A1 * 6/2018 Williams ..... A63B 69/0057
2020/0298046 A1 * 9/2020 Davis ..... A63B 21/00069

* cited by examiner

RACQUET SWING TRAINING SYSTEM AND METHOD OF SWING TRAINING

CROSS REFERENCE TO RELATED APPLICATIONS

This application claims the benefit of priority to U.S. provisional patent application No. 63/291,850, filed on Dec. 20, 2021; the entirety of which is hereby incorporated by reference herein.

BACKGROUND OF THE INVENTION

Field of the Invention

The invention relates to a racquet swing training system for racquet sports and methods of swing training thereof.

Background

Individuals engaged in racquet sports often want to warm up and/or strengthen their swing. There are some elastic tether devices described in the prior art but these devices connect to the strings of the racquet which can damage the strings or they attach to the handle which does not provide strengthen the wrist as the attachment is proximal the hand.

SUMMARY OF THE INVENTION

The invention is directed to a racquet swing training system and method of using the same. The racquet swing training system may comprise a racquet for a wide array of racquet sports including, but not limited to tennis, racquetball, badminton, squash, table tennis, and pickleball. A cover is configured to extend over the racquet and has a hook configured to detachably attach to an elastic band. The elastic band extends from hook on the cover to a support and provides resistance as the racquet is swung. The hook on the cover is effectively retained and secured by a stiffener plate. In addition, the hooks may be coupled with a pivot to enable the hooks to rotate down parallel with the cover when not is use for compact storage.

The racquet may comprise an extended end, a handle end, a handle, and a racquet portion. The handle may be configured for a user to grip and hold the racquet, and the racquet portion may be configured to make contact with another object, for example, a ball. The racquet portion may be a stringed racquet portion comprising strings or may be a solid racquet portion, such as for table tennis or pickleball. In various embodiments, the racquet may be the appropriate, size, shape, and material to be used in a variety of racquet sports, such as but not limited to tennis, racquetball, pickleball, and squash.

The racquet swing training system may further comprise a cover. The cover may comprise a first side, a second side opposite the first side, and a perimeter extending between the first and second side. The cover may further comprise an extended end and an open end. The cover may further comprise a centerline axis that extends from the open end to the extended end. The cover may further comprise a width axis that extends perpendicular to the centerline axis. The cover may further comprise a pocket configured between the first and second side. The pocket may be configured to receive the racquet portion of the racquet. The cover may be dimensioned appropriately to accept the racquet portion of the racquet when the racquet portion of the racquet is inserted into the pocket of the cover. When the racquet portion of the racquet is inserted into the pocket of the cover, the extended end of the racquet may contact the extended end of the cover.

The first side of the cover may comprise an outer layer and an inner layer. The inner layer may be a cushioning material, such as but not limited to a felt, foam, fabric, or other material that is elastic in its thickness. The cushioning material may serve to protect the racquet from an inner fastener portion of a fastener for retaining the hook, or the stiffener plate, which is described further herein.

The cover further comprises an opening to the pocket located at the open end of the cover, opposite to the extended end of the cover. The cover may further comprise a closure feature that may extend from the opening along a portion of the perimeter of the cover. In some embodiments, the closure feature may extend about 30% of the perimeter or more, about 50% of the perimeter or more, about 75% of the perimeter or more, and any range between and including the percentages provided. The closure feature may be configured to expand the opening for inserting the racquet portion of the racquet into the pocket of the cover. Thus, a closure feature that extends further along the perimeter may allow for a larger opening. A closure feature that extends along a lesser portion of the perimeter may allow for quicker expansion and contraction of the opening. The closure feature may be, but is not limited to, a zipper, series of buttons, hook-and-loop fastener, series of snaps, series of laces, single lace, or any combination thereof.

The cover may further comprise a stiffener plate configured on the first side of the cover. The stiffener plate may be configured between the outer layer and the inner layer of the first side of the cover. The stiffener plate may be free-standing. The term "free-standing" as used herein to describe the stiffener plate is defined as maintaining a shape regardless of orientation, wherein the material is stiff and rigid, and not a supple layer of fabric or film that drapes. The stiffener material may have a flexural modulus that is effective to retain the hooks and prevent the cover from excessively bowing and stretching during swing training. The Most commonly used standards to measure Flexural Modulus are ASTM D790 and ISO 178. Flexural modulus values are significantly different from the tensile modulus because the stress created in the specimen is both tension and compression. The data is useful for comparing the strength and stiffness of different plastics when a load carrying part is subjected to bending in service. For ASTM D790, the test is stopped when the specimen reaches 5% deflection or the specimen breaks before 5%. For ISO 178, the test is stopped when the specimen breaks. If the specimen does not break, the test is continued as far as possible and the stress at 3.5% (conventional deflection) is reported. A stiffener plate may have a minimum flexural modulus of at least, or modulus at 5% deflection of about 0.75 Gpa or more, about 1 Gpa or more, about 1.5 Gpa or more, about 2.0 Gpa or more and may have a thickness of about 2 mm or more, about 3 mm or more, about 4 mm or more, about 5 mm or more, about 6 mm or more and any range between and including the flexural modulus and thickness values provided. The higher the flexural modulus the thinner the stiffener sheet may be and still provide effective support during swing training. Table 1 provides flexural modulus values according to ASTM D790, for a wide variety of plastic materials, some being reinforce, that may be used as stiffening plates. Note that the reinforced plastics listed, having a min flexural modulus of 2.5 or more may be more expensive but may be lighter weight and may enable a thinner stiffener plate.

TABLE 1

| Polymer Name | Flexural Modulus 5% Min Value (Gpa) | Flexural Modulus Max Value (Gpa) |
|---|---|---|
| HDPE-High Density Polyethylene | 0.75 | 1.575 |
| ETFE-Ethylene Tetrafluoroethylene | 0.8 | 1.4 |
| PA 66-Polyamide 6-6 | 0.8 | 3 |
| PA 66, Impact Modified | 0.8 | 1.2 |
| PMP-Polymethylpentene | 0.8 | 1.5 |
| PA 11, Rigid | 1 | 1.48 |
| PA 46-Polyamide 46 | 1 | 3.2 |
| PA 6-10-Polyamide 6-10 | 1 | 2 |
| PP (Polypropylene) Copolymer | 1 | 1.4 |
| PA 12, Rigid | 1.17 | 1.48 |
| PCTFE-Polymonochlorotrifluoroethylene | 1.2 | 1.5 |
| PP (Polypropylene) Homopolymer | 1.2 | 1.6 |
| POM (Acetal) Impact Modified | 1.4 | 2.3 |
| PP, 10-40% Mineral Filled | 1.4 | 3.1 |
| PTFE, 25% Glass Fiber-reinforced | 1.4 | 1.7 |
| ASA-Acrylonitrile Styrene Acrylate | 1.5 | 2.4 |
| HIPS-High Impact Polystyrene | 1.5 | 3 |
| PMMA (Acrylic) Impact Modified | 1.5 | 3.5 |
| PP, 10-40% Talc Filled | 1.5 | 4 |
| PVDF-Polyvinylidene Fluoride | 1.5 | 2 |
| ABS-Acrylonitrile Butadiene Styrene | 1.6 | 2.4 |
| PC/PBT Blend-Polycarbonate/Polybutylene Terephthalate Blend | 1.6 | 3.9 |
| ECTFE | 1.7 | 1.7 |
| PMP Mineral Filled | 1.7 | 2 |
| PA 12, Glass Filled | 1.75 | 2 |
| Polyamide semi-aromatic | 1.8 | 2.11 |
| SMA, Flame Retardant V0 | 1.9 | 2 |
| ABS Flame Retardant | 2 | 4 |
| ABS/PC Blend-Acrylonitrile Butadiene Styrene/Polycarbonate Blend | 2 | 2.3 |
| ASA/PC Blend-Acrylonitrile Styrene Acrylate/Polycarbonate Blend | 2 | 2.6 |
| ASA/PVC Blend-Acrylonitrile Styrene Acrylate/Polyvinyl Chloride Blend | 2 | 2.2 |
| HIPS Flame Retardant V0 | 2 | 2.5 |
| PAR-Polyarylate | 2 | 2.3 |
| PBT-Polybutylene Terephthalate | 2 | 4 |
| POM (Acetal) Low Friction | 2 | 3 |
| SMMA-Styrene Methyl Methacrylate | 2 | 3.2 |
| PPA-Polyphthalamide | 2.1 | 3.7 |
| PPE-Polyphenylene Ether | 2.1 | 2.8 |
| PPE, Impact Modified | 2.1 | 2.8 |
| PVC Rigid | 2.1 | 3.5 |
| PC-Polycarbonate, high heat | 2.2 | 2.5 |
| PETG-Polyethylene Terephthalate Glycol | 2.2 | 2.2 |
| SMA-Styrene Maleic Anhydride | 2.3 | 3.3 |
| PPSU-Polyphenylene Sulfone | 2.38 | 2.41 |
| PPE, Flame Retardant | 2.4 | 2.5 |
| PI-Polyimide | 2.48 | 4.1 |
| ABS/PC Flame Retardant | 2.5 | 3 |
| ASA/PC Flame Retardant | 2.5 | 2.5 |
| COC-Cyclic Olefin Copolymer | 2.5 | 3.5 |
| CPVC-Chlorinated Polyvinyl Chloride | 2.5 | 3.2 |
| PESU-Polyethersulfone | 2.5 | 2.7 |
| PMMA-Polymethylmethacrylate/Acrylic | 2.5 | 3.5 |
| PMMA (Acrylic) High Heat | 2.5 | 4.3 |
| PP-Polypropylene 10-20% Glass Fiber | 2.5 | 3.5 |
| PS (Polystyrene) Crystal | 2.5 | 3.5 |
| PSU-Polysulfone | 2.7 | 3 |
| EVOH-Ethylene Vinyl Alcohol | 2.8 | 5.8 |
| PC/PBT blend, Glass Filled | 2.8 | 6.9 |
| PET-Polyethylene Terephthalate | 2.8 | 3.5 |
| POM-Polyoxymethylene (Acetal) | 2.8 | 3.7 |
| Amorphous TPI, High Heat, High Flow, Transparent, Lead-Free Solderable (Standard Flow) | 2.85 | 2.85 |
| PPE, Mineral Filled | 2.9 | 3.5 |
| Amorphous TPI Blend, Ultra-high heat, Chemical Resistant (High Flow) | 3 | 3 |
| PA 11-(Polyamide 11) 30% Glass fiber | 3 | 3 |
| reinforced PA 12, Fiber-reinforced | 3 | 13.7 |

TABLE 1-continued

| Polymer Name | Flexural Modulus 5% Min Value (Gpa) | Flexural Modulus Max Value (Gpa) |
|---|---|---|
| PA 66, Impact Modified, 15-30% Glass Fiber | 3 | 7 |
| PEI-Polyetherimide | 3 | 3.4 |
| PHB-Polyhydroxybutyrate | 3 | 3.2 |
| PS, High Heat | 3 | 3.5 |
| Amorphous TPI, Moderate Heat, Transparent (Mold Release grade) | 3.07 | 3.07 |
| Amorphous TPI, Moderate Heat, Transparent | 3.08 | 3.08 |
| Amorphous TPI, Moderate Heat, Transparent (Food Contact Approved) | 3.08 | 3.08 |
| Amorphous TPI, Moderate Heat, Transparent (Powder form) | 3.08 | 3.08 |
| PAN-Polyacrylonitrile | 3.1 | 3.8 |
| PEKK (Polyetherketoneketone), Low Crystallinity Grade | 3.3 | 3.4 |
| SAN-Styrene Acrylonitrile | 3.5 | 4.2 |
| Amorphous TPI, Highest Heat, Chemical Resistant, 260C UL RTI | 3.6 | 3.6 |
| TPI-PEEK Blend, Ultra-high heat, Chemical Resistant, High Flow, 240C UL RTI | 3.6 | 3.6 |
| PEEK-Polyetheretherketone | 3.7 | 4 |
| PESU 10-30% glass fiber | 3.8 | 8.4 |
| PLA-Polylactide | 3.8 | 3.8 |
| PPS-Polyphenylene Sulfide | 3.8 | 4.2 |
| PA 66, 30% Mineral filled | 3.9 | 4.1 |
| PAI-Polyamide-Imide | 4 | 7 |
| POM (Acetal) Mineral Filled | 4 | 5.5 |
| PP, 30-40% Glass Fiber-reinforced | 4 | 7 |
| PSU Mineral Filled | 4 | 5 |
| PVC (Polyvinyl Chloride), 20% Glass Fiber-reinforced | 4.5 | 7 |
| PE-Polyethylene 30% Glass Fiber | 4.9 | 5.6 |
| PA 66, 30% Glass Fiber | 5 | 8 |
| PAI, Low Friction | 5 | 7 |
| PEI, Mineral Filled | 5 | 7 |
| PMP 30% Glass Fiber-reinforced | 5 | 6 |
| SMA, 20% Glass Fiber-reinforced | 5 | 6 |
| PPA, 30% Mineral-filled | 5.4 | 5.6 |
| PP Homopolymer, Long Glass Fiber, 30% Filler by Weight | 5.5 | 5.5 |
| ABS/PC Blend 20% Glass Fiber | 5.9 | 6.1 |
| PC (Polycarbonate) 20-40% Glass Fiber | 6 | 10 |
| PPS, 20-30% Glass Fiber-reinforced | 6 | 12 |
| SRP-Self-reinforced Polyphenylene | 6.2 | 8.3 |
| PC (Polycarbonate) 20-40% Glass Fiber Flame Retardant | 7 | 8 |
| PET, 30/35% Glass Fiber-reinforced, Impact Modified | 7 | 9 |
| PP Homopolymer, Long Glass Fiber, 40% Filler by Weight | 7 | 7 |
| PPE, 30% Glass Fiber-reinforced | 7 | 9 |
| PSU, 30% Glass fiber-reinforced | 7 | 8.5 |
| SAN, 20% Glass Fiber-reinforced | 7 | 9 |
| PA 46, 30% Glass Fiber | 7.8 | 3.2 |
| Amorphous TPI, High Heat, High Flow, Lead-Free Solderable, 30% GF | 9 | 9 |
| PBT, 30% Glass Fiber | 9 | 11.5 |
| PEEK 30% Glass Fiber-reinforced | 9 | 10 |
| PEI, 30% Glass Fiber-reinforced | 9 | 9 |
| PET, 30% Glass Fiber-reinforced | 9 | 12 |
| PP Homopolymer, Long Glass Fiber, 50% Filler by Weight | 9 | 9 |
| LCP-Liquid Crystal Polymer | 10 | 19 |
| PPA, 33% Glass Fiber-reinforced-High Flow | 10 | 12 |
| PPS, Glass fiber & Mineral-filled | 10 | 17 |
| PS (Polystyrene) 30% glass fiber | 10 | 10 |
| PA 66, Glass Fiber, Long, 40% Filler by Weight | 10.5 | 10.5 |
| PAI, 30% Glass Fiber | 11 | 15 |
| PARA (Polyarylamide), 30-60% glass fiber | 11 | 21 |

TABLE 1-continued

| Polymer Name | Flexural Modulus 5% Min Value (Gpa) | Flexural Modulus Max Value (Gpa) |
|---|---|---|
| PPA, 33% Glass Fiber-reinforced | 11.3 | 11.5 |
| LCP Mineral-filled | 12 | 20 |
| PPS, 40% Glass Fiber-reinforced | 12 | 15 |
| LCP Glass Fiber-reinforced | 13 | 24 |
| PA 66, Glass Fiber, Long, 50% Filler by Weight | 13 | 13 |
| PEEK 30% Carbon Fiber-reinforced | 13 | 19 |
| PPA, 45% Glass Fiber-reinforced | 13.7 | 13.9 |
| PA 66, Glass Fiber, Long, 60% Filler by Weight | 17 | 17 |
| PPS, Conductive | 17 | 19 |
| PA 66, Carbon Fiber, Long, 30% Filler by Weight | 18 | 18 |
| PA 66, Carbon Fiber, Long, 40% Filler by Weight | 24 | 24 |
| LCP Carbon Fiber-reinforced | 31 | 37 |

The stiffener plate may extend an area inside the pocket of the cover that is substantially the same as an area of the pocket of the cover; wherein the stiffener plate has an area that is about 80% or more the area of the pocket of the cover, or even about 90% or more the area of the pocket. Area of the pocket cover is the flat area defined by the perimeter of the cover. It has been surprising discovered that when the stiffener plate is substantially the same area as the cover, the cover, while being a supple material, such as a fabric and/or film effectively supports and retains the hooks during swing training.

The stiffener plate may be made out of any material that allows the stiffener plate to be free-standing, such as but not limited to plastic, wood, ceramic, metal, or any combination thereof. Various materials may be choses based on their stiffness and/or weight. For example, plastic is a relatively lightweight material that would enable the stiffener plate to be free-standing. The stiffener plate may have a thickness to provide effective stiffness for swing training and the thickness may be about 2 mm or more, about 4 mm or more, about 5 mm or more, about 7 mm or more, about 10 mm or more, or any range between and including the thickness values provided. A thicker stiffener plate may allow for a stiffer stiffener plate that holds its shape better when subjected to forces. A thinner stiffener plate may allow for a lighter stiffener plate that is more easily swung when the racquet swing training system is in use.

The racquet swing training system may comprise one or more hooks coupled to the stiffener plate. The hook may be coupled to the stiffener plate such that it extends out from the first side of the cover. The hook may be coupled to the stiffener plate by means of a fastener. Alternatively, the hook may be coupled to the cover by means of but not limited to a weld, solder, snap feature, or press-fit. In some embodiments, the hook may form a closed loop.

The racquet swing training system may comprise a plurality of hooks coupled to the cover and the hooks may be positioned for specific strengthening and swing training purposes. One, two, three or more hooks may be configured along the centerline axis and one or more may be configured an offset distance from the centerline axis, or offset across the width of the cover. A hook may form a closed loop or may form an open loop for attachment of an elastic band.

A first hook and second hook may be configured substantially along the centerline axis of the cover, which for the purposes of this description means that the first and second hooks are located no more than 25 mm from the centerline axis, and preferably no more than 10 mm from the centerline axis, and even more preferably no more than 5 mm from the centerline axis. The first and second hook may be offset a centerline distance along the centerline axis from each another. In some embodiments, the centerline distance is about 50 mm or more, or about 100 mm or more, about 150 mm or more and any range between and including the centerline distances provided. A smaller centerline distance between the first and second hooks allows for less of a change in resistance and feel when using the racquet swing training system. A greater centerline distance between the first and second hooks allows for a greater change in resistance and feel when using the racquet swing training system. A hook configured more proximal to the extended end of the cover will provide more torque on the handle during swing training, for example and may more effectively strengthen the forearm.

One or more hooks may be offset a width distance from the centerline axis. The width distance may be a distance along the width axis of the cover. In some embodiments, the width distance may be about 10 mm or more, about 25 mm or more, about 50 mm or more, about 75 mm or more and any range between and including the offset width distances provided. A hook configured an offset width distance from the centerline will provide a torsional force on the handle during swing training and may strengthen a person's grip.

The hook or hooks may be coupled with a pivot and configured to rotate down towards the cover and up from the cover. The pivot may enable the hook to rotate about 90 degrees from vertical to flat against the first side of the cover, or about 180 degrees from flat against the first side of the cover to flat against the first side of the cover, passing a 90-degree vertical point between the two positions of flat against the first side of the cover.

The racquet swing training system may a plurality of elastic bands that may provide different resistances as described herein. A user may start with a low resistance elastic band and then increase the resistance to swinging by changing out the elastic band for a higher resistance elastic band or by coupling two or more elastic bands between the hook or hooks and a support. An exemplary elastic band has a racquet end and a support end. The racquet end is configured to detachably attach to a hook and the support end is configured to a support, which may be a fixed support, such as a fence or pole, for example. The elastic band may have hooks, clips, or other attachment features for quickly attaching to the cover hooks and support. In some embodiments, the number of elastic bands in the racquet swing training system may be equal to the number of hooks.

The support end of the elastic band may be configured to detachably attach to a support. When the support end of the elastic band is detachably attached to the support, and when the racquet end of the elastic band is detachably attached to the hook, the racquet may be swung to enable swing training with resistance from the elastic band. A plurality of elastic bands may be provided with the racquet swing training system and the elastic bands may provide different resistance. A first elastic band may provide a first resistance when stretched 50% of an original length and a second elastic band may provide a second resistance, which is higher than the first resistance, when stretched 50% of an original length. The second resistance may be about 25% higher, about 50% higher, about 100% higher or more that of the first resistance. A user may switch from the first elastic band, having a first resistance, to the second elastic band, having a substantially higher resistance than said first elastic band, as they strengthen their swing. An elastic band may be a band, cord, braid, strap and the like. An original length of an elastic band is a length when not under load, which may be measured by laying the elastic band out on a horizontal surface and measuring the length.

The method of using the racquet swing training system described herein may comprise providing the racquet swing training system, detachably attaching the support end of an elastic band to a support, detachably attaching the racquet end of the elastic band to a hook extending from the cover, grasping the handle, and swinging the racquet to swing train with resistance form the elastic band. The method may include attaching a second elastic band to the same hook or a second hook and the second support end of the second elastic band to a support, which may be the same as the support for the first elastic band, and subsequently swinging the racquet. Furthermore, the method may include switching from a first elastic band to a second elastic band having a higher resistance, as described herein. The method may further comprise then removing the cover and using the racquet for racquet sport, such as but not limited to tennis, racquetball, pickleball, or squash.

A support includes, but is not limited to, a wall, railing, fence, pole, a portion of the user, such as their waist or leg, or any other heavy or object that may be a permanently affixed object.

The method of using the racquet swing training system may comprise moving the racquet from a first portion to a second position. In the second position, the racquet may be positioned further from the support than in the first position. Also in the second position, the elastic band may be stretched to a greater length than in the first position.

The method described herein enables a user to practice swing training with their own racquet that has a grip that they will be using during play. Therefore, the method is more effective than those that use a separate racquet for training from the racquet used for play. A user may however want to use a different racquet for swing training, such as a racquet with a larger or smaller handle to strength different muscles and/or to provide more comfort.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
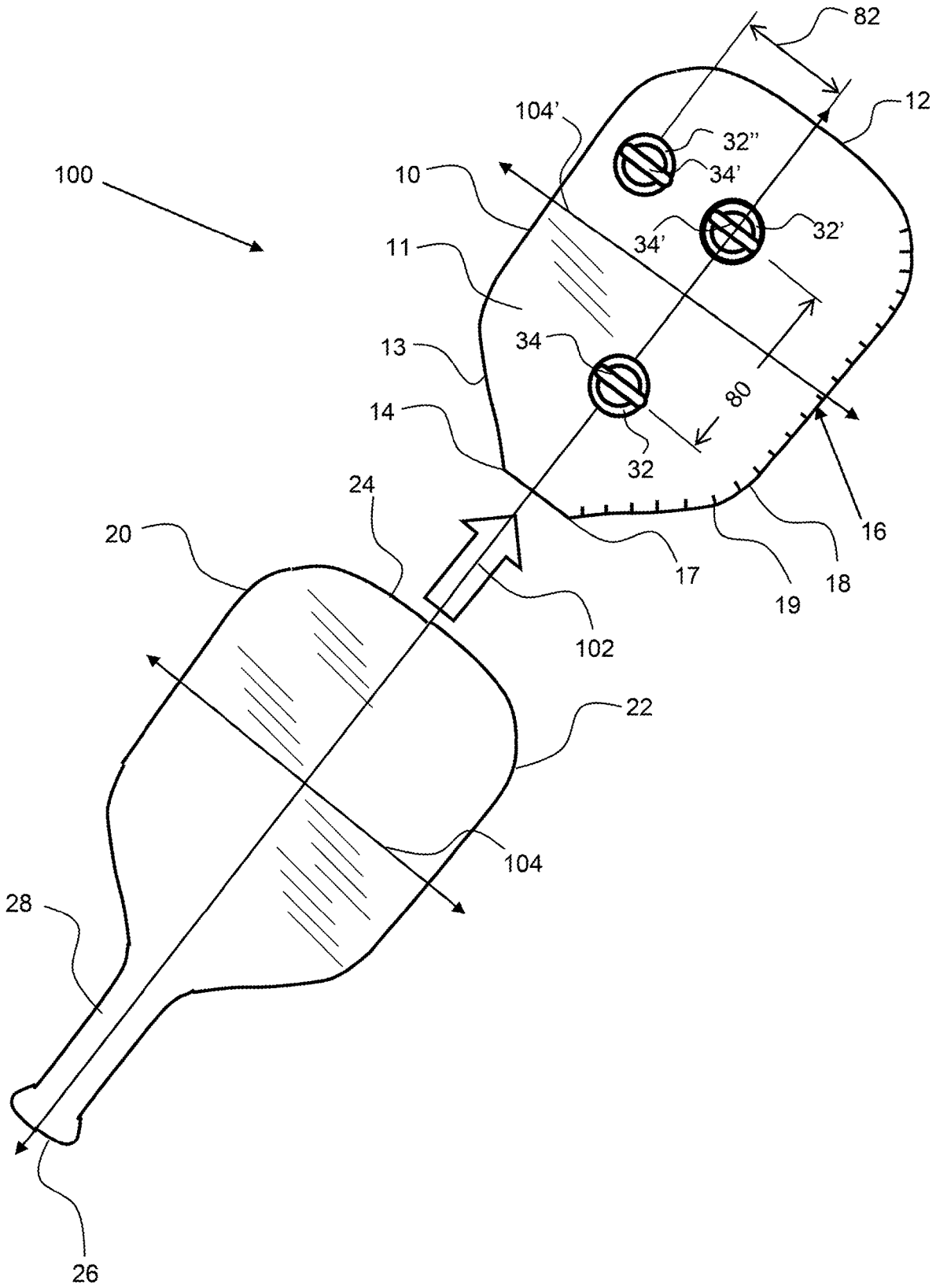
FIG. 1 shows a front view of an exemplary embodiment of a racquet swing training system.

Corresponding reference characters indicate corresponding parts throughout the several views of the figures. The figures represent an illustration of some of the embodiments of the present invention and are not to be construed as limiting the scope of the invention in any manner. Some of the figures may not show all of the features and components of the invention for ease of illustration, but it is to be understood that where possible, features and components from one figure may be included in the other figures. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

FIG. 1 shows a racquet swing training system 100 comprising a cover 10 and a racquet 20. The racquet comprises an extended end 24 and a handle end 26. The racquet comprises a racquet portion 22 on the extended end, and a handle 28 on the handle end 26. A centerline axis 102 extends centrally along the length of the racquet from the handle end 26 to the extended end 24 and a width axis 104 extends orthogonally to the centerline axis across the width of the racquet.

The cover 10 comprises a first side 11, a second side 13, opposite the first side, an extended end 12, an open end 14, and a perimeter 16 that extends between the first side and the second side. The centerline axis 102 extends centrally along the length of the cover, when the cover is configured on the racquet, from the open end to the extended end and a width axis 104' extends orthogonally to the centerline axis across the width of the cover. The open end 14 of the cover 10 comprises an opening 17 for the handle 28 of the racquet to extend therethrough when the cover is configured on the racquet. The opening can be enlarged by the closure feature 18 extends from the open end 14 of the cover 10 along a length of the perimeter 16. The closure feature may extend about half way around the perimeter or more to allow the racquet to be configured into the cover. The closure feature may be a zipper 19.

The cover 10 comprises three hooks 34, 34', and 34". Two of said hooks 34 and 34' are configured along the centerline axis 102, and are offset from one another by a centerline distance 80. The first hook 34 is configured more proximal to the handle or open end 14 and the second hook 34' is configured more proximal to the extended end 12. Attachment of an elastic band to the second hook 34' will provide more torque on the handle 28 and may be used to strengthen the wrist. The third hook 34" is offset from the centerline axis 102 and the first and second hooks by a width distance 82. The third hook may provide twisting force during swing training to strengthen the forearm and grip. The cover 10 also comprises three baseplates 32, 32', and 32" configured to provide stability and support for the hooks coupled to the cover.

Figure 2:
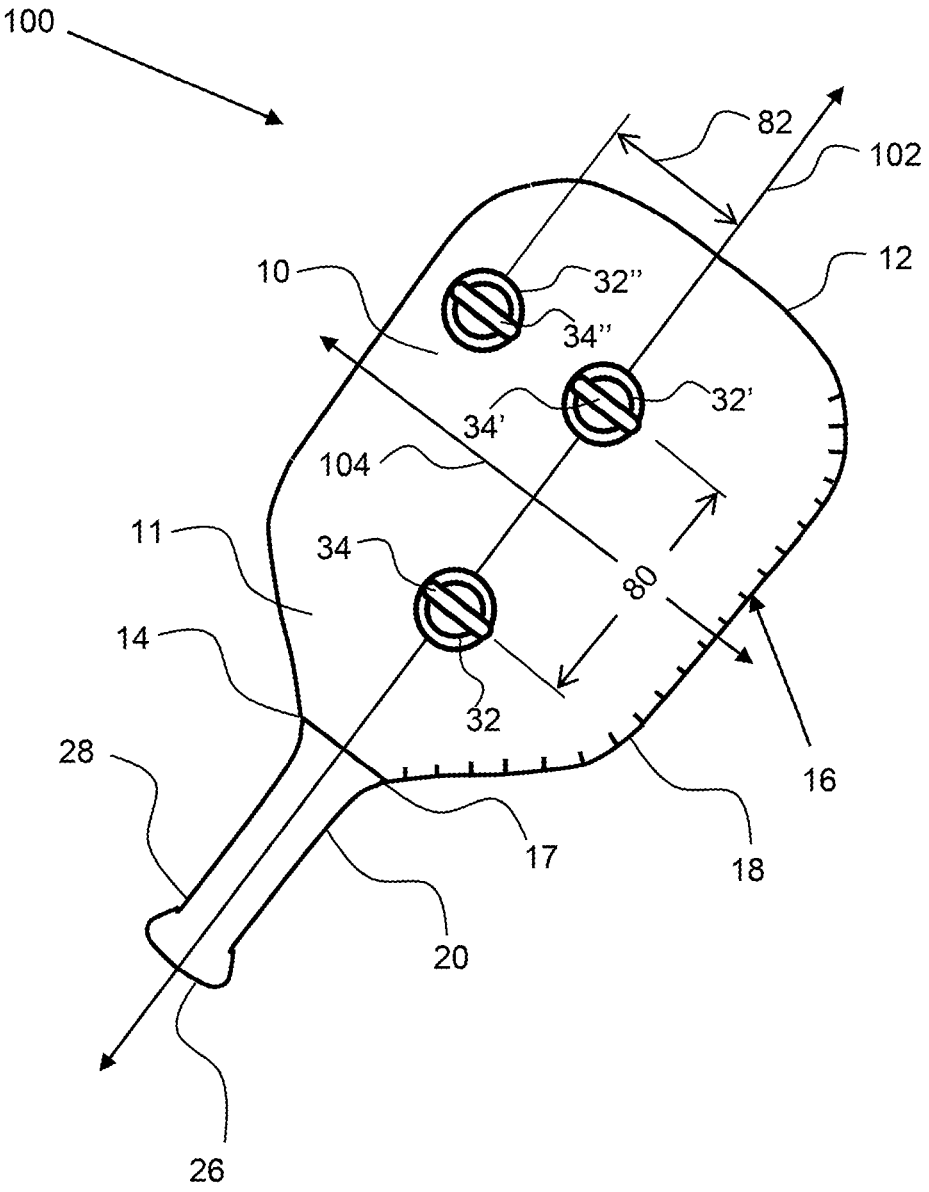
FIG. 2 shows a front view of an exemplary embodiment of a racquet swing training system wherein a racquet is configured within a pocket of a cover.

FIG. 2 shows the racquet swing training system 100 of FIG. 1 with the racquet 20 configured within the cover 10. The cover encases the racquet portion of the racquet and only the handle 28 and handle end 26 of the racquet 20 extend out from the opening 17 of the cover. Because of the configuration of the racquet 20 inside of the cover 10, the racquet 20 and cover 10 share the same centerline axis 102.

Figure 3:
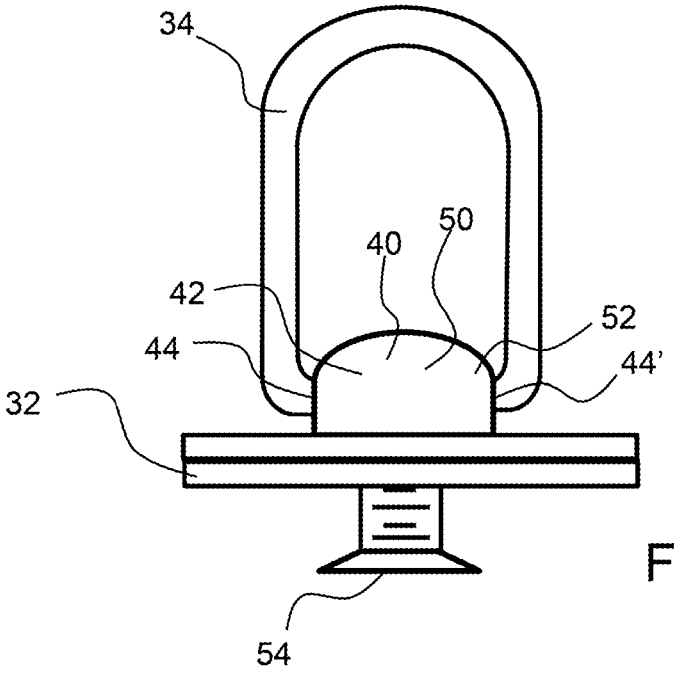
FIG. 3 shows a front view of an exemplary embodiment of a hook, fastener, pivot, and baseplate.
Figure 4:
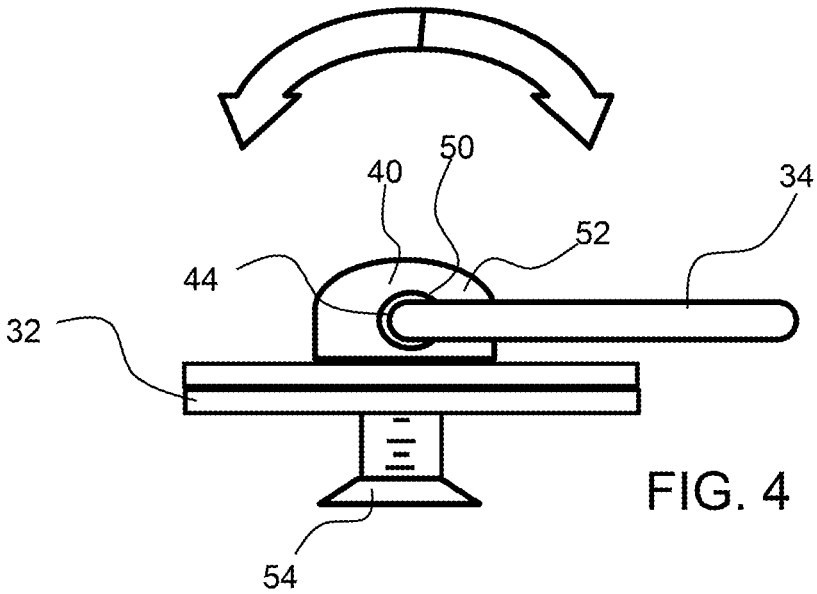
FIG. 4 shows a side view of an exemplary embodiment of a hook, fastener, pivot, and baseplate with the hook rotated down about the pivot.
Figure 5:
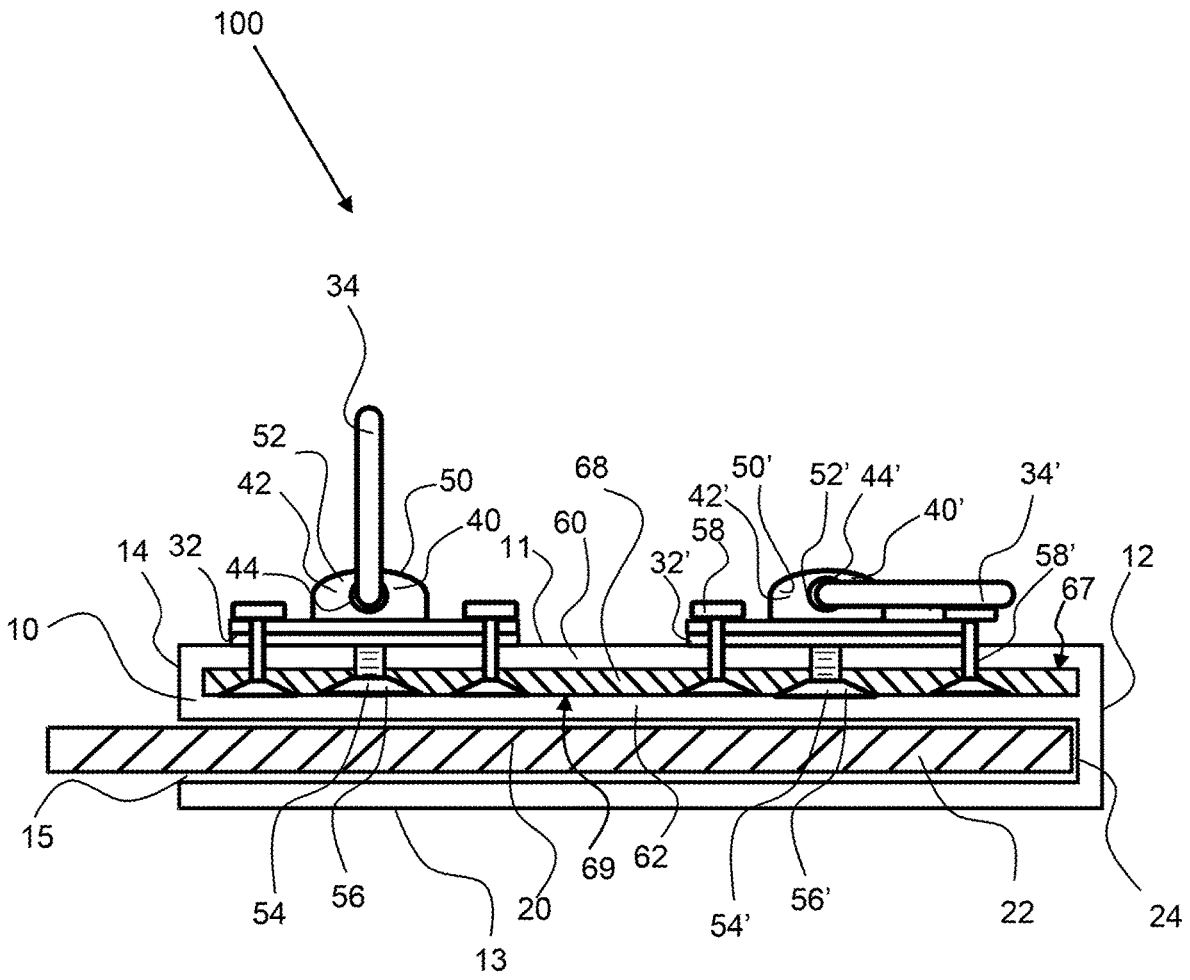
FIG. 5 shows a side cross-sectional view of an exemplary embodiment of a racquet swing training system wherein a racquet is configured in a pocket of a cover.

Referring now to FIGS. 3 to 5, an exemplary hook 34, is coupled with a pivot 40 to enable the hook to rotate about the pivot. This rotation enables the hook to become low profile and lay flat against the cover when not in use, which may enable better packing and storage and prevent damage to other racquets from a protruding hook, when they are stacked for storage and transport. The pivot may be coupled with a baseplate 32 to provide additional structural support. The exemplary pivot may comprise a body portion 42 having or forming a pivot aperture 44 or apertures 44, 44' for a portion of the hook to extend therein or therethrough. A portion of the hook 40 may extend into the aperture or apertures or the hook may extend completely through the aperture, wherein the aperture extends completely through the body portion 42.

The hook is coupled with a fastener 50 having an outer fastener portion 52 and an inner fastener portion 54. The outer fastener portion 52 is configured on the hook-side surface 67 of the stiffener plate 68 and may be on the outside of the cover 10. The inner fastener portion 54 is the portion that is coupled with the stiffener plate 68 of the cover 10. As shown, the inner fastener portion 54 may be tapered to enable a flush configuration along the stiffener plate shown in FIG. 5. The inner fastener portion may be a recessed fastener 56, recessed into the pocket-side surface 69 of the stiffener plate 68, or internal to the outer surface of the cover. The inner fastener portion may be tapered and recessed into the stiffener plate having a corresponding tapered recess, such as a beveled recess to receive the tapered inner fastener portion. The fastener 50 secures the hook 34, pivot 40, and baseplate 32 to the stiffener plate 68 of the cover 10. The outer or inner fastener portions may be threaded to couple the two portions together. Additional torsion fasteners 58, 58' may be configured to couple the base plate 32 to the stiffener plate 68 and may be offset from the pivot 40 or the fastener 50 for the pivot to provide effective support for torsion on the baseplate 32 during swing training.

The baseplate 32 serves as a barrier between the cover and the pivot. As shown in FIG. 3, the hook is extended up and as shown in FIG. 4, the hook is rotated down to extend parallel with the baseplate 32. The hook may rotate about 180 degrees to provide a range of motion during swing training and also to enable the hook to lay flat against the cover for storage.

FIG. 5 shows a side cross-sectional view of a racquet swing training system 100. with the racquet 20 in the cover 10. The first side 11 and second side 13 of the cover forms a pocket 15 to receive and retain the racquet portion 22 of the racquet 20. The first side 11 of the cover 10 as shown in FIG. 4 comprises an inner layer 62, and outer layer 60, and a stiffener plate 68. The stiffener plate 68 is configured between the inner layer 62 and outer layer 60. The inner fastener portions 54 and 54' of a first fastener 50 and second fastener 50', respectively, couple with the stiffener plate 68. A first baseplate 32 and second baseplate 32' are configured between the outer layer 60 and a first and second outer pivots 40, 40'. The two fasteners 50 and 50' each comprise an outer fastener portion 52 and 52' in addition to the inner fastener portions 54 and 54'. The inner fastener portions may be tapered and fit into a beveled aperture in the stiffener plate 68 to provide a low-profile engagement, which may prevent damage to the racquet portion 22 of the racquet. In an exemplary embodiment, when the racquet portion 22 of the racquet 20 is configured within the pocket 15, the inner layer 62 of the cover 10 is configured between the racquet 20 and stiffener plate 68.

Figure 6:
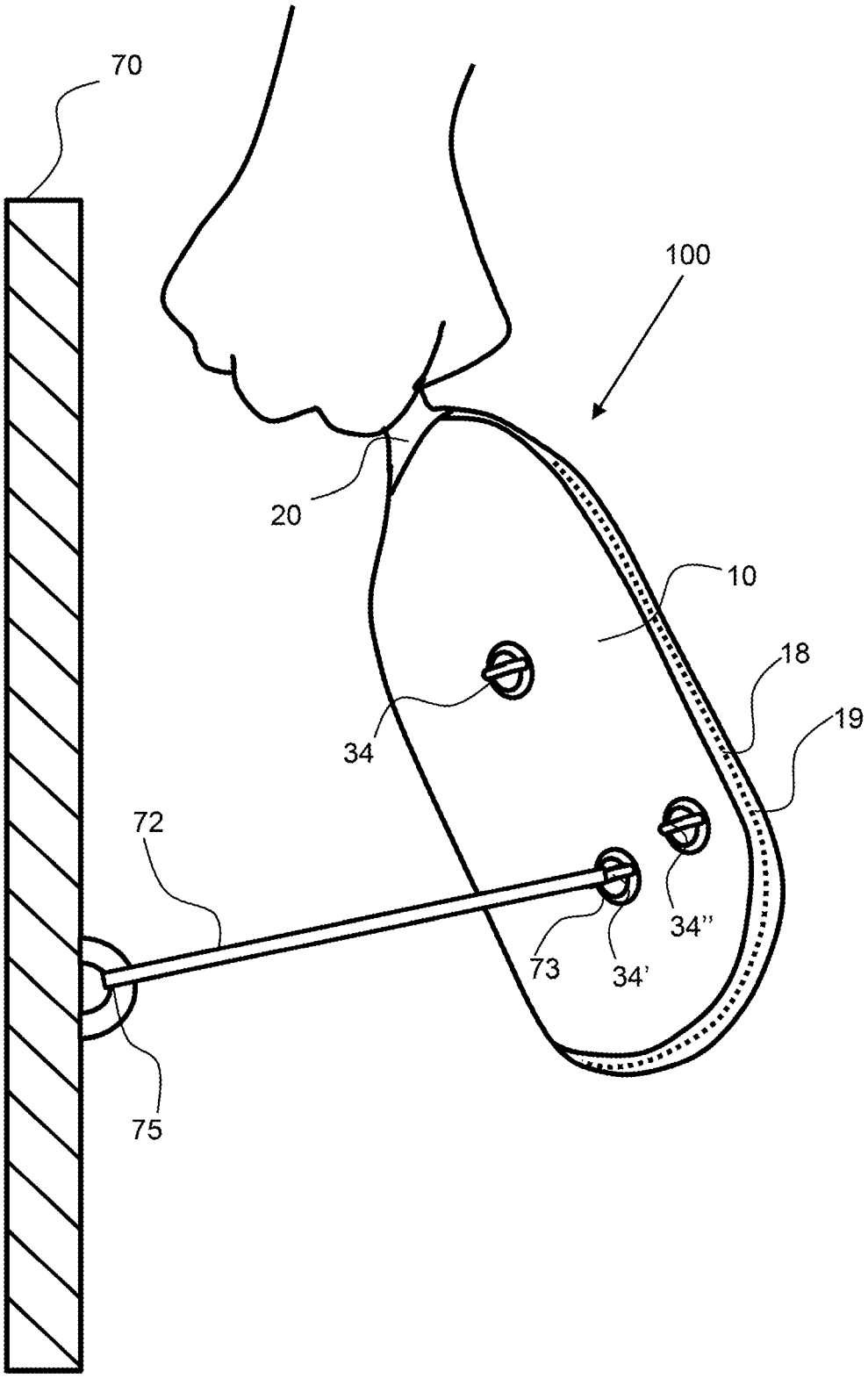
FIG. 6 shows a perspective view of an exemplary embodiment of a racquet cover configured on a racquet and coupled to a support by an elastic band, with the racquet being in a first position.

FIG. 6 shows a racquet swing training system 100 in a first position. An elastic band 72 comprises a support end 75 coupled to a support 70, and a racquet end 73 coupled with a second hook 34'.

Figure 7:
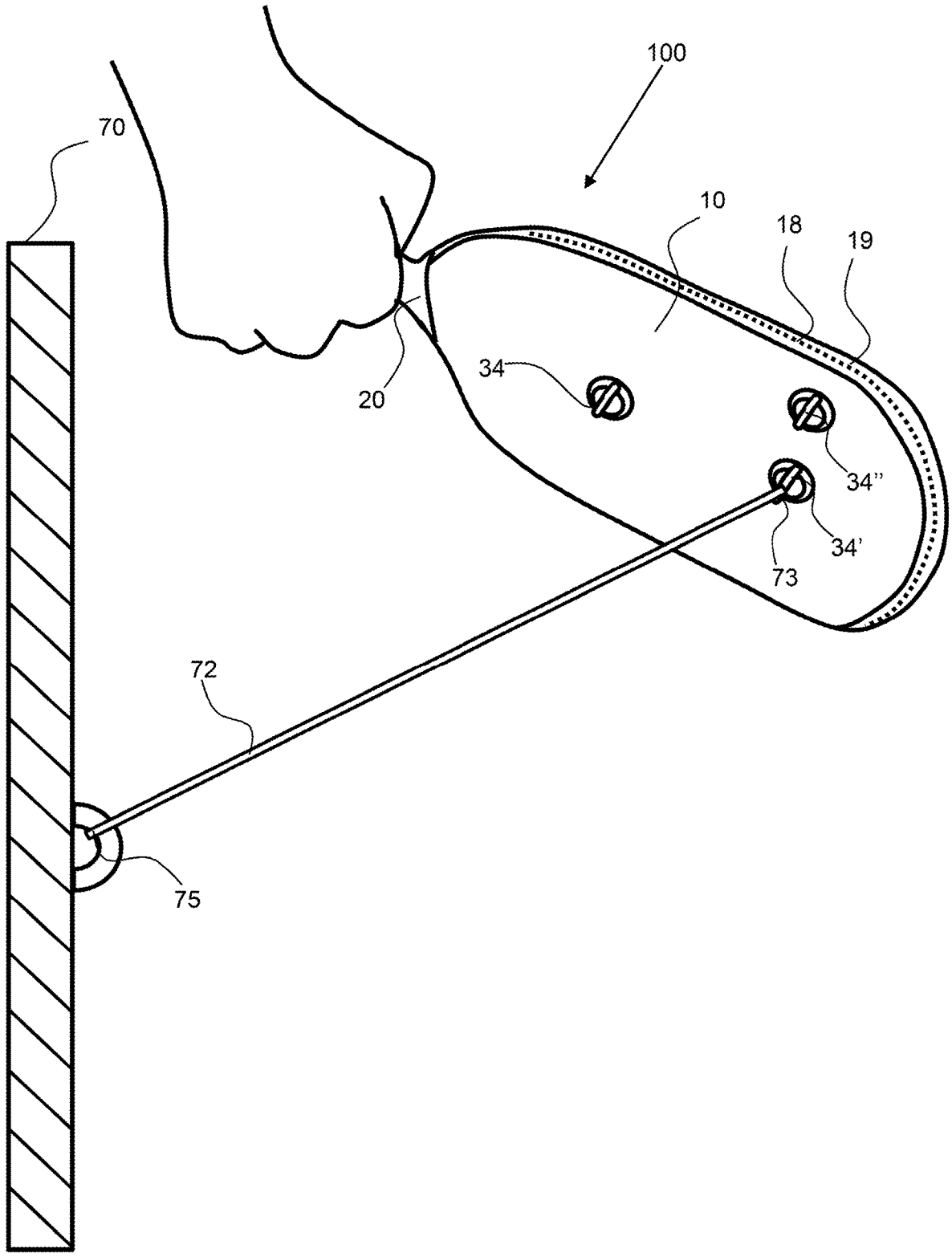
FIG. 7 shows a perspective view of an exemplary embodiment of a racquet cover configured on a racquet and coupled to a support by an elastic band, with the racquet being in a second position.

FIG. 7 shows the racquet training system 100 of FIG. 6, in a second position. In the second position, the support end 75 of the elastic band 72 is still connected to the support 70 and the racquet end 73 of the elastic band 72 is still connected to the second hook 34', which is connected to the cover 10 and the stiffening plate. In the second position, the cover 10 is a further distance from the support 70 than in the first position, and the elastic band 72 is stretched to a greater length than in the first position.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A method of swing training comprising:

a) providing the racquet swing training system comprising:

i) a racquet comprising;
an extended end;
a handle end;
a handle; and
racquet portion;

ii) a cover comprising:
a first side;
a second side opposite the first side;
perimeter extending between and around the first side and the second side;
a pocket configured between the first side and the second side for receiving the racquet portion;
an opening to said pocket;
a closure feature extending from said opening along a portion of the perimeter of the cover and configured to expand the opening for inserting the racquet portion into the pocket; and
a stiffener plate configured on said fist side, wherein said stiffener plate is free-standing;
iii) a first hook coupled to the stiffener plate and extended out from the first side; and
iv) an elastic band comprising:
a racquet end; and
a support end;
wherein the racquet end of the elastic band is configured to detachably attach to said first hook;
b) detachably attaching the support end of the elastic band to a support;
c) detachably attaching the racquet end of the elastic band to the first hook;
d) grasping the handle;
e) swinging the racquet from a first position to a second position to swing train, wherein the elastic band provides a resistance to said swinging;
wherein in the second position the racquet is positioned further from the support than in the first position, and wherein in the second position the elastic band is stretched to a greater length than in the first position
f) removing the cover; and
g) using the racquet for a racquet sport.

2. The method of claim 1, further comprising:
a) providing a second elastic band comprising:
i) a racquet end; and
ii) a support end;
wherein the racquet end of the second elastic band is configured to detachably attach to said first hook;
wherein the second elastic band has a resistance when stretched 50% of an original length that is at least 25% higher than a resistance of the first elastic band when stretched 50% of an original length;
b) coupling the racquet end of the second elastic band to the first hook;
c) coupling the support ed of the second elastic band to a support;
d) grasping the handle of the racquet; and
e) moving the racquet from a first position to a second position;
wherein in the second position the racquet is positioned further from the support than in the first position, and wherein in the second position the elastic band is stretched to a greater length than in the first position.

3. The method of claim 1, further comprising a pivot and wherein the first hook is configured to pivot about said pivot.

4. The method of claim 3, wherein the first hook is configured to pivot about said pivot at least 90 degrees from vertical to flat against the first side.

5. The method of claim 3, wherein the first hook is configured to pivot about said pivot at least 180 degrees.

6. The method of claim 1, wherein the first side comprises an outer layer and an inner layer and wherein stiffener plate is configured between the outer layer and the inner layer.

7. The method of claim 1, wherein the racquet swing training system further comprises a second hook.

8. The method of claim 7, wherein the first hook is configured substantially along a centerline axis of the cover and the second hook is configured substantially along the centerline axis of the cover a centerline distance from the first hook.

9. The method of claim 8, further comprising a first pivot and wherein the first hook is configured to pivot about said first pivot at least 90 degrees from vertical to flat against the first side, and a second pivot, wherein the second hook is configured to pivot about said second pivot at least 90 degrees from vertical to flat against the first side.

10. The method of claim 7, wherein the first hook is configured a width distance of at least 25 mm from a centerline axis of the cover and the second hook is configured substantially along the centerline axis of the cover.

11. The method of claim 10, further comprising a first pivot and wherein the first hook is configured to pivot about said first pivot at least 90 degrees from vertical to flat against the first side, and a second pivot, wherein the second hook is configured to pivot about said second pivot at least 90 degrees from vertical to flat against the first side.

12. The method of claim 1, wherein the stiffener plate has an area that is substantially the same as a pocket area of the cover wherein the stiffener plate has an area that is 80% or more the pocket area.

13. The method of claim 12, wherein the stiffener plate has flexural modulus at 5% of at least 0.75 Gpa and a thickness of at least 3 mm.

14. The racquet swing training system of claim 1, wherein the closure feature extends at least 30% of the perimeter.

15. The method of claim 1, wherein the racquet is a pickle ball racquet.

16. The method of claim 1, further comprising a fastener, wherein the first hook is coupled to the stiffener plate by said fastener, wherein the fastener has an outer portion and an inner portion.

17. The method of claim 16, further comprising a pivot having a pivot body;
wherein the first hook is configured to pivot about said pivot;
wherein the fastener has an outer portion that forms a portion of said pivot body.

18. The method of claim 17, wherein the inner portion of the fastener is a recessed fastener being recessed in a pocket-side surface of the stiffener plate.

* * * * *